United States Patent [19]

Schopper et al.

[11] 4,030,281

[45] June 21, 1977

[54] SURVEYING DEVICE

[75] Inventors: Alf Schopper, Meyrin; Jean Linder, Genf, both of Switzerland

[73] Assignee: Heberlein Hispano S.A., Vernier-Genf, Switzerland

[22] Filed: Aug. 19, 1975

[21] Appl. No.: 605,937

[30] Foreign Application Priority Data

Sept. 3, 1974 Switzerland ..... 11986/74

[52] U.S. Cl. ..... 57/87; 19/.25; 57/34 R; 242/37 R

[51] Int. Cl.[2] ..... D01H 13/18; D01H 13/26

[58] Field of Search ..... 57/34 R, 83, 86, 87, 57/107; 242/29, 37 R, 37 A; 226/11, 100; 19/.25

[56] References Cited

UNITED STATES PATENTS

| | | | |
|---|---|---|---|
| 1,481,982 | 1/1924 | Brace et al. | 57/87 X |
| 2,611,230 | 9/1952 | Saunders et al. | 57/87 |
| 2,734,335 | 2/1956 | Saunders et al. | 57/86 |
| 3,128,590 | 4/1964 | Escursell-Prat | 57/34 R |
| 3,626,680 | 12/1971 | Whitney | 57/86 X |
| 3,638,412 | 2/1972 | Rebsamen | 57/86 X |
| 3,643,883 | 2/1972 | Wuest | 57/86 X |
| 3,751,896 | 8/1973 | Ford | 57/87 |
| 3,924,297 | 12/1975 | Ingham, Jr. | 57/86 X |

*Primary Examiner*—Richard C. Queisser
*Assistant Examiner*—Charles Gorenstein
*Attorney, Agent, or Firm*—Larson, Taylor and Hinds

[57] ABSTRACT

Apparatus for surveying the condition of roving is mounted on an automatic yarn knotting device movable along a spindle row in a textile machine having a drafting device for roving allocated to each spindle. When a roving breakage is indicated, the knotting device stops at the appropriate position and a first detecting device on a pivoted lever is moved to a position in which it checks the presence of roving passing through the drafting device. If there is no roving due to exhaustion of supply, no knotting is effected, but if roving is present the knotting device is prepared and a second lever moves a second detecting device to two output rollers for delivery of roving from the drafting device. If this second device detects no wrapping of roving on one of the two output rollers, the knotting process is initiated. If a wrapping is detected, a separating or pinching device, previously brought into operative position on the first lever, is actuated to interrupt the supply of roving to the drafting device and the yarn knotting device continues along the spindle row.

6 Claims, 8 Drawing Figures

SURVEYING DEVICE

FIELD OF THE INVENTION

The present invention relates to surveying apparatus for an automatic yarn knotting device movable along a spindle row in a textile machine, especially a spinning machine.

DESCRIPTION OF THE PRIOR ART

A device is known which, when a yarn breakage occurs beyond the drafting device, actuates a yarn brake for interrupting the feed of yarn, whereby the yarn is interrupted at the feed rollers of the drafting device, thus reducing the loss of raw material.

An interruption of the yarn feed to the drafting device is however not always desirable, particularly if an automatic yarn knotting device movable along the spindle row is provided on the spinning machine, the yarn knotting device eliminating yarn breakages automatically after they have occurred.

In order to assure safe yarn knotting, it is necessary for the roving to be in the drafting device on the one hand and on the other hand not to become wrapped around the output delivery rollers of the drafting device.

SUMMARY OF THE INVENTION

It is the purpose of the present invention to avoid the disadvantages of the known devices and particularly to provide a surveying apparatus of the above-described type which assures an improvement of the capacity of automatic yarn knotting devices in the absence of roving or if the roving is interrupted in the drafting device and/or if the roving has been wrapped around the output delivery rollers. This is effected by checking the presence of roving in the drafting device and also detecting the wrapping of roving around the output delivery rollers before the knotting is effected.

According to the present invention, this is achieved primarily by providing a detector device which checks the presence of roving in the drafting device, a device for detecting wrapping of roving around the output delivery rollers of the drafting device and by providing a separating or pinching device controllable by the device for detecting the wrapping of roving around the output delivery rollers for interrupting the feed of roving to the drafting device.

Thereby, in a simple manner, a considerable increase of the capacity of the automatic yarn knotting device is achieved since, after a yarn breakage has been detected in known manner by the yarn knotting device and before automatic knotting is started, such a check is effected by the device of the present invention as to find out first if the yarn is broken or the roving reserve exhausted and second if the roving has been wrapped around one of the output delivery rollers of the drafting device.

If the detector detects the presence of roving, there is a yarn breakage and the roving is not exhausted, and the automatic yarn knotter is prepared for knotting. If the absence of roving is detected, wherefrom the exhaustion of the roving reserve is concluded, the yarn knotting device is not prepared for knotting since such a knotting step would be unsuccessful anyhow; in this case, the yarn knotting device continues its course along the spindle row to detect further yarn breakages.

If the device for detecting wrappings of roving around the output delivery rollers of the drafting device detects such a wrapping, on one hand the order is given to the separating or pinching device to interrupt the feed of roving to the drafting device either by severing the roving or by pinching the roving and thereby causing the yarn to be torn apart under the effect of the drafting device, whereby further wrapping and consequently damage to or destruction of the output delivery rollers by continuous increase of diameter as well as further losses of roving are avoided; on the other hand, the automatic yarn knotting device receives the order to continue its movement along the spindle row and to detect further yarn breakages.

If no wrapping around the output delivery rollers of the drafting device is detected, the prepared knotting device is definitely activated and the knotting process initiated.

As appears from the above, the surveying apparatus of the present invention so increases the capacity of automatic yarn knotting devices that a yarn knotting step is only induced if all conditions for successful yarn knotting are fulfilled. If not all conditions are fulfilled, the yarn knotting device continues to move along the spindle row to detect further yarn breakages.

Very advantageously the detector device and the separating or alternatively pinching device may be arranged for movement, preferably on a lever pivotally mounted on the yarn knotting device, whereby the mobility of the yarn knotting device can be preserved and whereby, furthermore, tolerances in the positions of drafting devices with respect to the yarn knotting device can be compensated.

The detector device in one form may consist of a microswitch which may comprise a lever for contacting the roving.

Advantageously, furthermore, the device for detecting wrapping of the roving around the output delivery rollers may be arranged for movement, preferably on a second lever pivoted on the yarn knotting device.

The detector device in another form may comprise an electro-optical sensor which preferably consists of a light source and of a photoelectric cell, each of which are arranged on one limb of a U-shaped element.

In a convenient embodiment of the invention, for a drafting device with two rubber output delivery rollers, the device for detecting wrapping of roving on the output delivery rollers of the drafting device may consist of two wheels arranged on the second lever and provided with axial openings, the distance of each wheel from the output roller to be surveyed being adjustable so that wrapping of roving on one of the output rollers of the drafting device effects rotation of one of said wheels and whereby, for each wheel, there is provided within the range of the openings a light source and a photo-electric cell for detecting the rotation of each individual wheel.

In a further embodiment of the invention, for a drafting device with one output delivery roller of rubber and one such roller of metal, the device for detecting wrapping of roving on the output delivery rollers of the drafting device may consist of a wheel disposed on the second lever and having axial apertures and of a contact tongue flexibly mounted on a shaft, whereby the distance between the wheel and the output delivery roller of rubber is adjustable so that wrapping of roving around the output delivery roller of rubber effects rotation of said wheel, a light source and a photo-electric cell being provided in the zone of the openings for detecting rotation of the wheel, the formation of wrappings of roving on the metal output delivery roller furthermore lifting the contact tongue away from the surface of the metal roller and thereby causing interruption of the electric path formed by the metal tongue and the metal output delivery roller.

The device of the present invention may advantageously comprise an optical and/or acoustical warning device actuatable either by the device for detecting wrappings of roving on the output delivery rollers of the drafting device or by the detector device, which indicates either that the roving is exhausted or that there is a wrapping on the output delivery rollers, whereby an intervention by the operating personnel becomes necessary.

As appears from the above, the technical progress and the inventive contents of the object of the present invention are achieved by the new individual features as well as particularly by combination and sub-combination of the features used.

DESCRIPTION OF THE DRAWINGS

An example of the invention will be described hereinafter with reference to the accompanying drawings, wherein.

Figure 1:
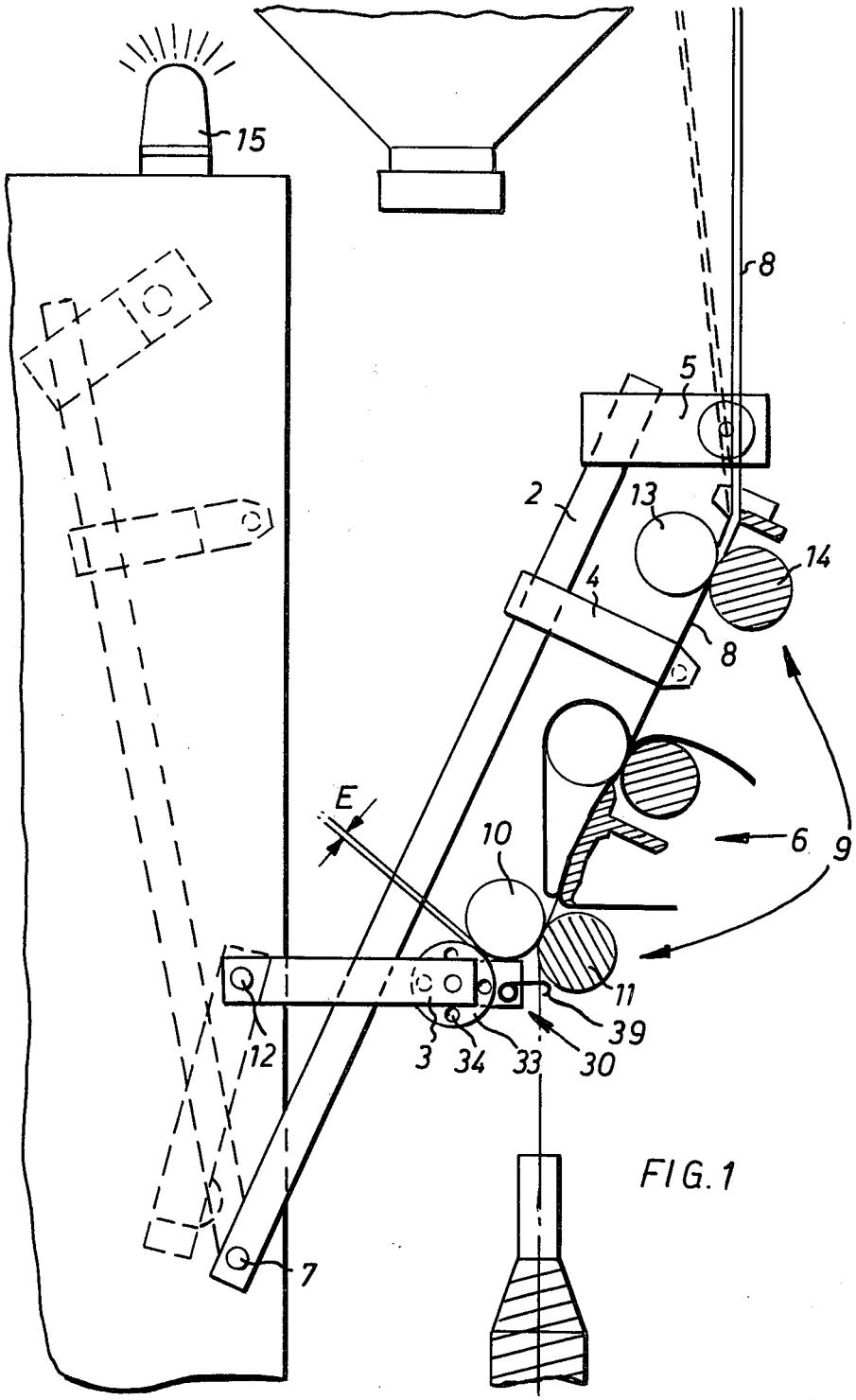
FIG. 1 shows an elevation of a surveying apparatus for an automatic yarn knotting device.

As becomes apparent from FIG. 1, the surveying apparatus consists on the one hand of a detecting device 4 with a pinching device 5 and on the other hand of a device 30 for detecting wrappings of roving on output delivery rollers 10, 11 of the drafting apparatus. The device 5 is provided for pinching roving 8 but alternative means may be provided for severing the roving.

A drafting device 9 in a known manner consists of two feed rollers 13, 14 of a pair of feeding belts 6 and the two output delivery rollers 10, 11.

The detecting device 4 and the pinching device 5 are fixed on a first lever 2 which is pivoted on a hinge pin 7 mounted on the casing of a yarn knotting device (not shown) by means of a driving device (not shown). The device 30 for detecting wrappings of roving is fixed on a second, pivoted lever 3 which is fixed on a hinge pin 12 on the casing 1 of the yarn knotting device. On the casing 1, there is furthermore provided an optical or acoustic warning device 15 for indicating faulty operation.

Figure 2:
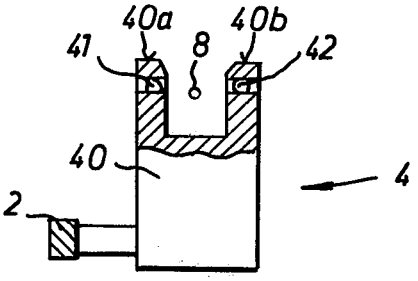
FIG. 2 is an elevation shown partly in section of a detecting device in the apparatus of FIG. 1.

As particularly shown in FIG. 2, the detecting device 4 consists of an U-shaped element 40 fixed on a first arm 2. The element 40 comprises a first limb 40*a* on which there is arranged a light source 41 and a second limb 40*b* on which there is arranged a photo-electric cell 42.

The arrangement of the light source 41 and of the photo-electric cell 42 permits the presence of roving 8 in the drafting device 9 to be detected.

Figure 3:
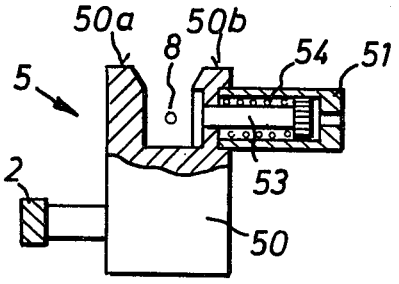
FIG. 3 is an elevation shown partly in section of a pinching device, shown prior to operation.
Figure 4:
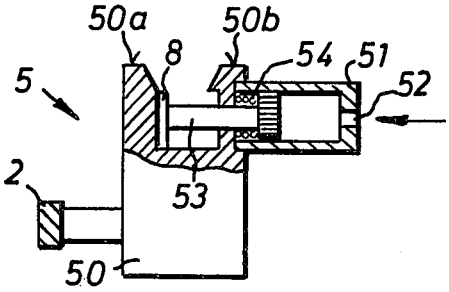
FIG. 4 is an elevation similar to that of FIG. 3 showing the pinching device after operation.

As shown in FIGS. 3 and 4, the pinching device 5 consists of an U-shaped element 50 which is also fixed on the first lever 2 and which comprises a first limb 50*a* and a second limb 50*b*. On the second limb 50*b*, there is arranged a pneumatically actuatable cylinder 51 which comprises a piston assembly 53 biased by a spring 54.

As shown particularly in FIG. 4, actuation of cylinder 51 compressed air entering through a port 52 forces the piston assembly 53 against the action of the spring so that the roving 8 is pinched between the piston assembly 53 and the first limb 50*a*.

Figure 5:
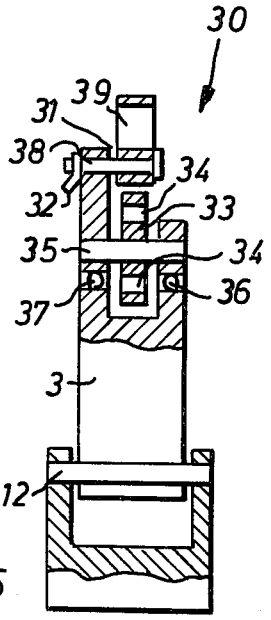
FIG. 5 is an elevation, shown partly in section, of a device for detecting wrappings of roving on output delivery rollers of a drafting device in the apparatus of FIG. 1.

FIG. 5 shows in detail the device 30 for detecting wrappings of roving on the output delivery rollers 10, 11 of the delivery device 9. This device consists on the one hand of a wheel 33 provided with axial bores 34 which is supported for rotation around a shaft 35 on the second lever 3, and on the other hand of a contact tongue 39 supported by a helicoidal spring 31 on a shaft 38 on the second lever 3.

In the zone of the bores 34 of wheel 33, there is provided a light source 37 and a photo-electric cell 36, whereby the rotation of wheel 33 can be detected.

The helicoidal spring 31 presses the contact tongue 39 against the surface of output delivery roller 11 as shown in FIG. 1. On shaft 38, there is furthermore provided an electrical contact 32. The delivery roller 11 is metallic but the roller 10 is of rubber.

As soon as the yarn knotting device detects a yarn breakage in the known manner, it is stopped at the respective position along the spindle row.

Thereafter, the first lever 2, carrying the detecting device 4 and the pinching device 5 is turned towards the drafting device 9 by the driving device (not shown). If, during, this turning movement, the presence of roving in the drafting device is detected by the detecting device 4, the automatic yarn knotting device is prepared and furthermore a driving device (not shown) for the second lever 3 carrying the device 30 for detecting wrappings of roving on output delivery rollers 10, 11 is activated. If no roving is detected in the drafting device 9 by detector device 4, the optical or acoustic warning device 15 is activated to indicate a disturbance in operation; in this case, the yarn knotting device is not prepared as yarn knotting can not be effected successfully in the absence of roving 8 in the drafting device 9.

Activation of the driving device of the second lever 3 causes the latter to carry the device 30 towards the output delivery rollers 10, 11 of drafting device 9. This movement is continued until the contact tongue 39 touches the surface of metallic output delivery roller 11 and until there is a predetermined separation E between the surface of rubber output delivery roller 10 and the surface of wheel 33.

If the contact tongue 39 is in contact with the surface of the metal roller 11, an electrical path is thus closed between the contact tongue 39 and the metal output delivery roller 11, whereby it may be concluded that there is no wrapping of roving on the metal output delivery roller 11. If, furthermore, the wheel 33 remains at a standstill, which can easily be detected by the photo-electric cell 36 and light source 37, it can be concluded that neither is there any wrapping of roving on rubber output delivery roller 10. In this case, the already prepared yarn knotting device is definitely activated and the proper yarn knotting step started.

If a wrapping of roving is detected on one of the output delivery rollers 10, 11 of the drafting device 9 either by electrical impulses from the rotation of wheel 33 or by interruption of the electrical path through the contact tongue 39 due to the separation of the tongue 39 from the surface of metal output delivery roller 11, the pneumatic cylinder 51 of the pinching device 5 is activated whereby the roving 8 is pinched between piston 53 and the first limb 50*a*. Due to rotation of the feed rollers 13, 14 of the stretching device 9, the roving 8 is torn apart between the pinching device 5 and feed rollers 13, 14 so that further wrapping of roving around one of the output delivery rollers 10, 11 of the drafting device 9 and accordingly destruction of damaging of the device 9 is avoided.

If the formation of wrappings of roving is detected, also the optical or acoustic warning device 15 is activated to indicate the disturbance in operation; the prepared yarn knotting device is not activated in this case since, because of the wrapping of roving, the yarn cannot be knotted successfully.

Figure 6:
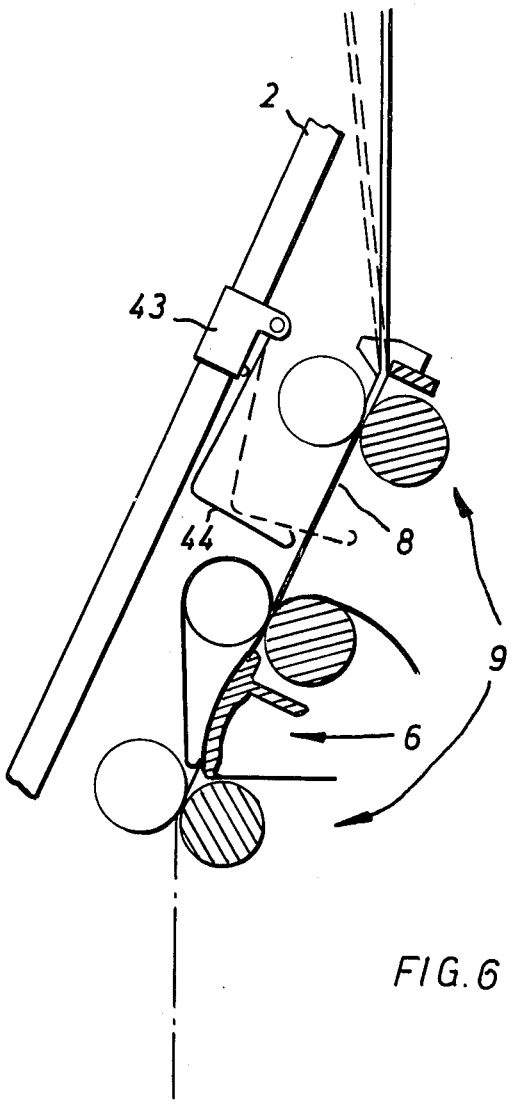
FIG. 6 is an elevation of a modified portion of the apparatus of FIG. 1.

FIG. 6 shows another embodiment of the detector device which consists of a microswitch 43 carrying a sensing lever 44 that detects the presence or absence of roving passing towards the feeding belts 6.

Figure 7:
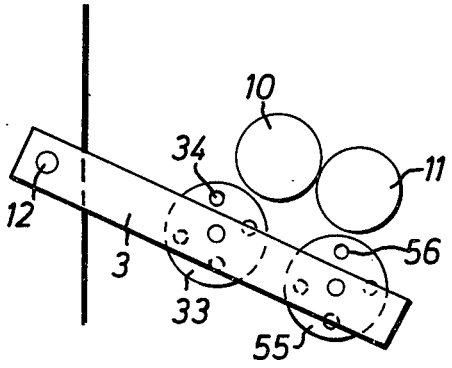
Figure 8:
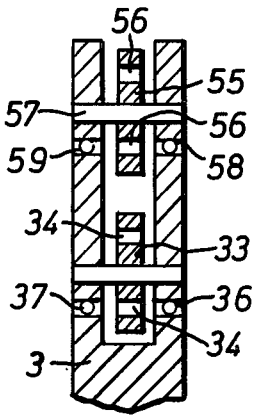

If the output delivery roller 11 is of rubber instead of metal, the contact tongue 39 may be replaced by a second wheel similar to the wheel 33 and also carried by the lever 3 as shown in FIGS. 7 and 8. The second wheel 55 provided with axial bores 56 which is supported for rotation around shaft 57 and lever 3 is arranged to operate in relation to the roller 11 in the same way as the wheel 33 in relation to the roller 10. In the zone of the bores 56 of wheel 55, there is also provided a light source 59 and a photo-electric cell 58.

We claim:

1. Surveying apparatus on an automatic knotting device movable along a spindle row in a texile machine including drafting devices respectively allocated to spindles for drafting rovings passing to said spindles, each said drafting devices including a pair of output delivery rollers between which roving is delivered to the associated spindle, said surveying apparatus comprising a lever pivotally mounted on the casing of the automatic knotting device, a first detecting device for checking the passage of roving through said drafting device, a device for pinching and interrupting the roving feed to said drafting devices, said first detecting device and said pinching and interrupting device being mounted on said lever, said lever being pivotable into and away from positions in which said first detecting device and said pinching and interrupting device are operatively related to the roving fed to and passing through said drafting devices, a member movably mounted on the casing of the automatic knotting device, a second detecting device for detecting the wrapping or roving around either one of said output delivery rollers, said second detecting device being mounted on said member and said member being movable into and away from a position in which said second detecting device is operatively related to said output delivery rollers.

2. Surveying apparatus according to claim 1 in which said first detecting device is an electro-optical sensor comprising a U-shaped element, a light source mounted on one limb of said element and a photo-electric cell mounted on the other limb of said element determining the presence of roving between said limbs.

3. Surveying apparatus according to claim 1, in which said pinching device consists of a reciprocable member mounted to lie on one side of roving passing to said drafting device, a stationary member mounted opposite said reciprocable member on the other side of the roving, and pneumatically actuable means for causing said reciprocable member to press the roving against said stationary member, thereby interrupting the passage of roving to said drafting device.

4. Surveying apparatus according to claim 1, in which said second detecting device comprises two wheels each mounted for free rotation about an axis on said movably mounted member, said wheels being positioned on said member respectively to lie adjacent but slightly spaced from said output rollers when said member is in said operative position and each said wheel being formed with a least one opening therethrough displaced from its axis, a light source and a photo-electric cell mounted respectively on opposite sides of one of said wheels, and a second light source and second photo-electric cell mounted respectively on opposite sides of the other of said wheels, whereby rotation of either of said wheels by contact with roving wrapped on the adjacent one of said rollers is indicated by the passage of said opening past the associated photo-electric cell.

5. Surveying apparatus according to claim 1, for use with a drafting device wherein at least one of the output rollers is of metal, and in which said second detecting device comprises an electrical contact tongue yieldingly mounted on said movably mounted member and a wheel mounted for free rotation about an axis on said movably mounted member, said contact tongue being positioned on said member to contact said metal one of said rollers and said wheel being positioned on said member to lie adjacent but slightly spaced from the other one of said rollers when said member is in said operative position, said wheel being formed with an opening therethrough displaced from its axis, and a light source and a photo-electric cell mounted respectively on opposite sides of said wheel, whereby when roving is wrapped on said metal one of said rollers an electrical path through said contact tongue is interrupted, and whereby rotation of said wheel by contact with roving wrapped on the other of said rollers is indicated by the passage of said opening past said photo-electric cell.

6. Surveying apparatus according to claim 1, in which said first detecting device comprises a sensing lever having one position wherein it engages roving passing through said drafting device and a second position in the absence of roving and an electrical switch operable by said lever in passing from said second position to said first position.

* * * * *